US012644651B2

(12) United States Patent
Bonnivard et al.

(10) Patent No.: US 12,644,651 B2
(45) Date of Patent: Jun. 2, 2026

(54) HEAT-EXCHANGE DEVICE COMPRISING FLOW LIMITING DEVICES, AIR-CONDITIONING SYSTEM AND VEHICLE

(71) Applicant: LIEBHERR-AEROSPACE TOULOUSE SAS, Toulouse (FR)

(72) Inventors: Florian Bonnivard, Toulouse (FR); Grégoire Hanss, Toulouse (FR); Anthony Serieye, Toulouse (FR); Vincent Letellier, Toulouse (FR)

(73) Assignee: LIEBHERR-AEROSPACE TOULOUSE SAS, Toulouse (FR)

( * ) Notice: Subject to any disclaimer, the term of this patent is extended or adjusted under 35 U.S.C. 154(b) by 226 days.

(21) Appl. No.: 18/719,381

(22) PCT Filed: Dec. 9, 2022

(86) PCT No.: PCT/EP2022/085259

§ 371 (c)(1),
(2) Date: Jun. 13, 2024

(87) PCT Pub. No.: WO2023/110685

PCT Pub. Date: Jun. 22, 2023

(65) Prior Publication Data

US 2025/0052507 A1 Feb. 13, 2025

(30) Foreign Application Priority Data

Dec. 13, 2021 (FR) ..... 2113414

(51) Int. Cl.
*F28D 9/00* (2006.01)
*F28F 3/02* (2006.01)

(52) U.S. Cl.
CPC ..... *F28D 9/0062* (2013.01); *F28F 3/025* (2013.01); *F28F 2250/106* (2013.01)

(58) Field of Classification Search
CPC ..... F28D 9/0062; F28D 9/00; F28F 3/025; F28F 3/027; F28F 2250/106
USPC ..... 165/165
See application file for complete search history.

(56) References Cited

U.S. PATENT DOCUMENTS 4,516,632 A * 5/1985 Swift ..... F28D 9/0075 366/DIG. 3
4,729,428 A * 3/1988 Yasutake ..... F28F 13/12 165/166
7,331,376 B2 * 2/2008 Gagnon ..... F28D 9/0068 165/166

(Continued)

*Primary Examiner* — Claire E Rojohn, III
(74) *Attorney, Agent, or Firm* — CRGO Global; Steven M. Greenberg

(57) ABSTRACT

The invention relates to a heat-exchange device comprising:
an exchanger block (12) disposed in a flow enclosure defined by two external plates,
said exchanger block comprising a first internal layer and a last internal layer allowing the flow of the first heat-transfer fluid, said exchanger block comprising a plurality of internal plates (13, 14, 15, 16) disposed substantially in parallel with each other between two ends of said exchanger block,
characterized in that each first internal layer and each last internal layer comprises at least one flow limiting device (20) configured to be able to impede, at least in part, the flow of said first stream of fluid in said internal layer.

8 Claims, 4 Drawing Sheets

(56) References Cited

U.S. PATENT DOCUMENTS 8,091,868 B2 * 1/2012 Robb ..... H01M 8/04126 261/107
8,936,668 B2 * 1/2015 Huizing ..... B01D 69/1071 96/12
10,845,068 B2 * 11/2020 Mullen ..... F24F 12/006
10,962,252 B2 * 3/2021 LePoudre ..... F24F 3/147
11,255,615 B2 * 2/2022 Streeter ..... F28F 9/0246
12,013,190 B2 * 6/2024 Strange ..... B23P 15/26
12,025,387 B2 * 7/2024 Walsh ..... F01D 1/14
12,038,235 B2 * 7/2024 Kaneko ..... F28D 1/05391
12,188,665 B2 * 1/2025 Watanabe ..... F28D 9/0068
12,247,795 B2 * 3/2025 Vandermeer ..... F28D 9/0056
12,405,064 B2 * 9/2025 Jensen ..... F28D 9/0075
2009/0071638 A1 * 3/2009 Murayama ..... F28D 9/0062 29/890.03
2010/0175859 A1 * 7/2010 Takada ..... F28D 9/0025 29/890.03
2011/0192579 A1 * 8/2011 Sotokawa ..... F28D 21/0015 165/166
2012/0037349 A1 * 2/2012 Takada ..... F28F 3/025 165/170
2012/0043064 A1 * 2/2012 Takada ..... F28F 3/025 165/166
2012/0061045 A1 * 3/2012 Huizing ..... B01D 53/268 428/319.3
2012/0073791 A1 * 3/2012 Dubois ..... B01D 67/0002 96/9
2012/0168136 A1 * 7/2012 Takada ..... F28D 9/0062 165/166
2012/0205081 A1 * 8/2012 Terai ..... F28D 9/0025 156/60
2013/0191079 A1 * 7/2013 Berukhim ..... F28D 9/0062 165/165
2014/0014289 A1 * 1/2014 Tan ..... F28D 9/0025 165/10
2014/0242900 A1 * 8/2014 Takada ..... F24F 13/02 29/890.03
2014/0326432 A1 * 11/2014 Dean ..... F28F 9/26 165/104.14
2014/0342132 A1 * 11/2014 Montie ..... F28D 21/0015 55/482
2014/0374067 A1 * 12/2014 Slayzak ..... F28F 19/00 165/104.26
2015/0041109 A1 * 2/2015 Zager ..... F28D 9/0062 165/166
2015/0060031 A1 * 3/2015 Dietrich ..... F28F 3/08 29/890.039
2016/0252269 A1 * 9/2016 Takeda ..... F28F 21/066 165/166
2019/0063844 A1 * 2/2019 Holzl ..... F28D 9/0062
2019/0247942 A1 * 8/2019 Aigner ..... F28F 21/084
2020/0080790 A1 * 3/2020 Sotokawa ..... F28F 3/025
2021/0063035 A1 * 3/2021 Shimizu ..... F28D 9/0062
2021/0088286 A1 * 3/2021 Sotokawa ..... B32B 5/022
2021/0207826 A1 * 7/2021 Sotokawa ..... F24F 12/006
2021/0239406 A1 * 8/2021 Shimizu ..... F28D 9/0037
2021/0254896 A1 * 8/2021 Borghese ..... F28F 21/084
2022/0099381 A1 * 3/2022 Pelletier ..... F28F 9/0265
2022/0412668 A1 * 12/2022 Strange ..... B23P 15/26
2023/0184493 A1 * 6/2023 Dulberg ..... F28D 9/0093
2023/0213291 A1 * 7/2023 Kasai ..... F28D 9/0068 165/166
2023/0221034 A1 * 7/2023 Hayashi ..... F24F 12/006 165/48.1
2023/0221076 A1 * 7/2023 Song ..... F28D 9/0081 165/166
2023/0235916 A1 * 7/2023 Wang ..... F28D 21/0015 454/252
2023/0266067 A1 * 8/2023 Miyake ..... F28F 3/046 165/166
2023/0296268 A1 * 9/2023 Watanabe ..... F28F 3/04
2023/0356847 A1 * 11/2023 Bonnivard ..... F28D 9/0062
2023/0375282 A1 * 11/2023 Izutani ..... F28F 3/00
2024/0003641 A1 * 1/2024 Sotokawa ..... B01D 63/085
2024/0151476 A1 * 5/2024 Jensen ..... F28F 3/027
2024/0200887 A1 * 6/2024 Cosher ..... B33Y 80/00
2024/0351695 A1 * 10/2024 Ricard ..... B64D 13/06
2025/0052507 A1 * 2/2025 Bonnivard ..... F28F 3/025
2025/0116464 A1 * 4/2025 Bonnivard ..... F24F 12/006

* cited by examiner

[Fig. 1]
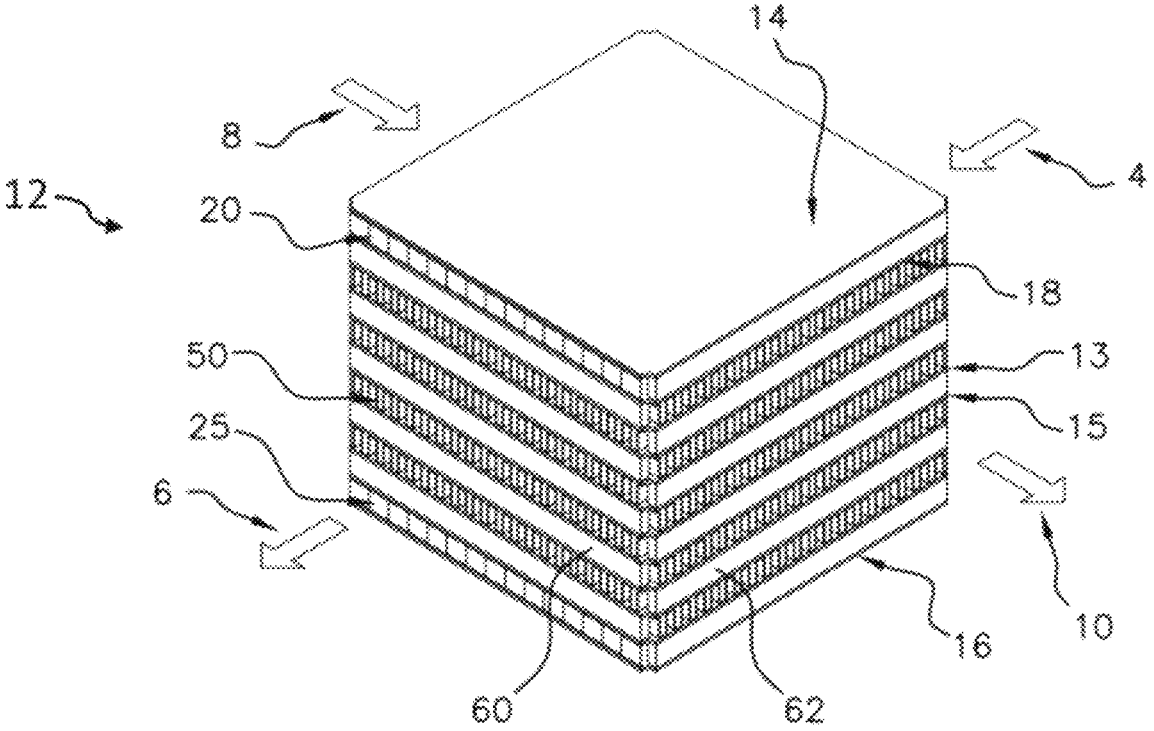
[Fig. 2]
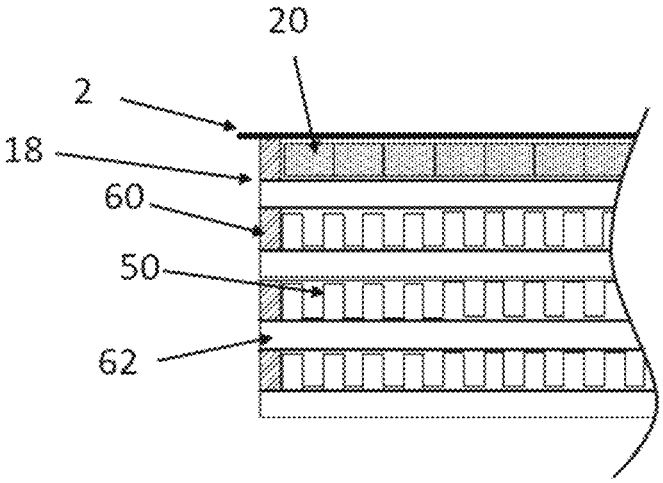

[Fig. 3]
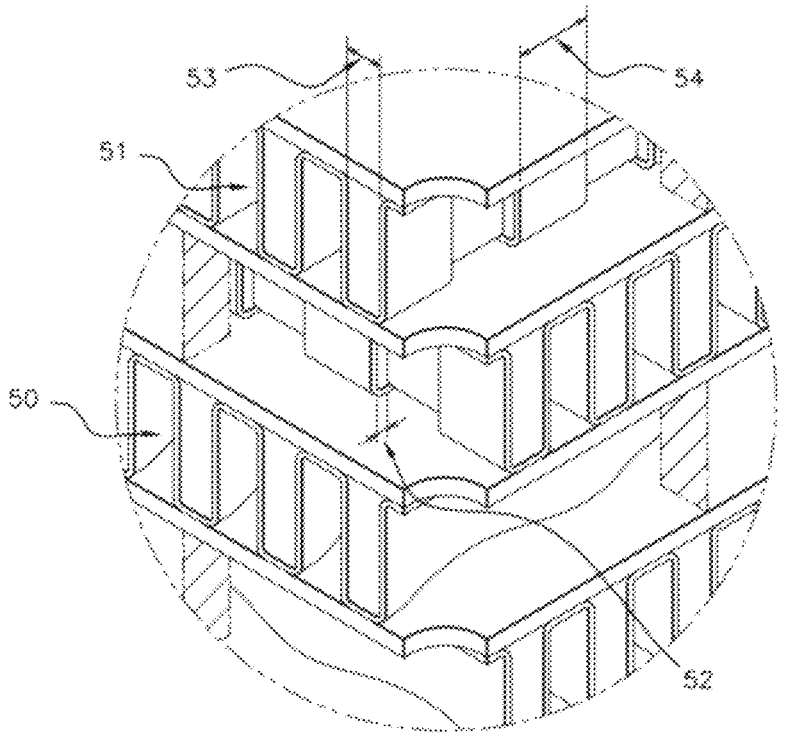

[Fig. 4]
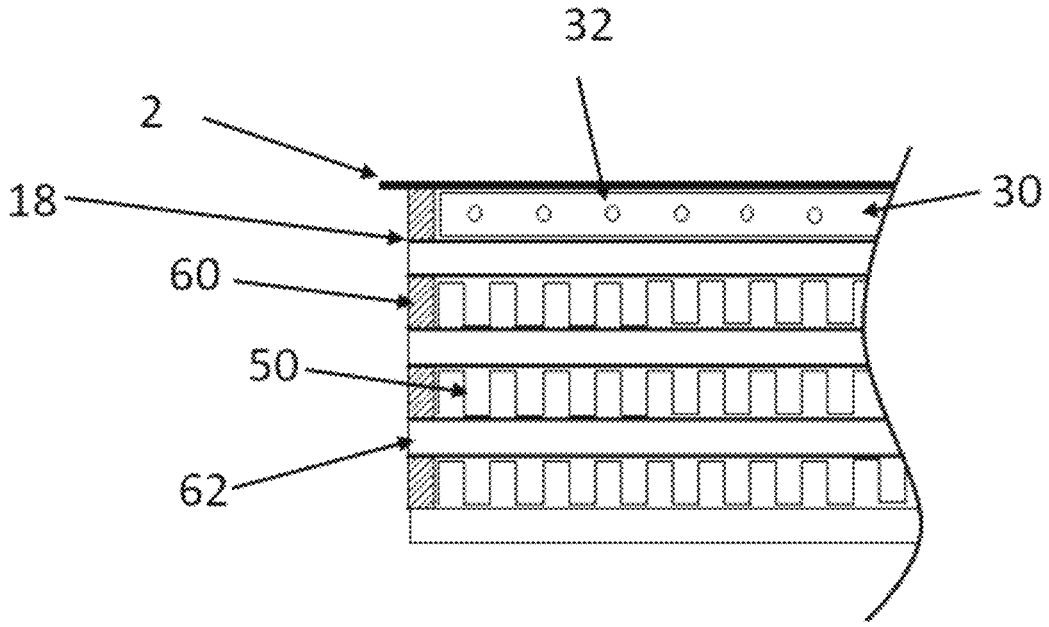
[Fig. 5]
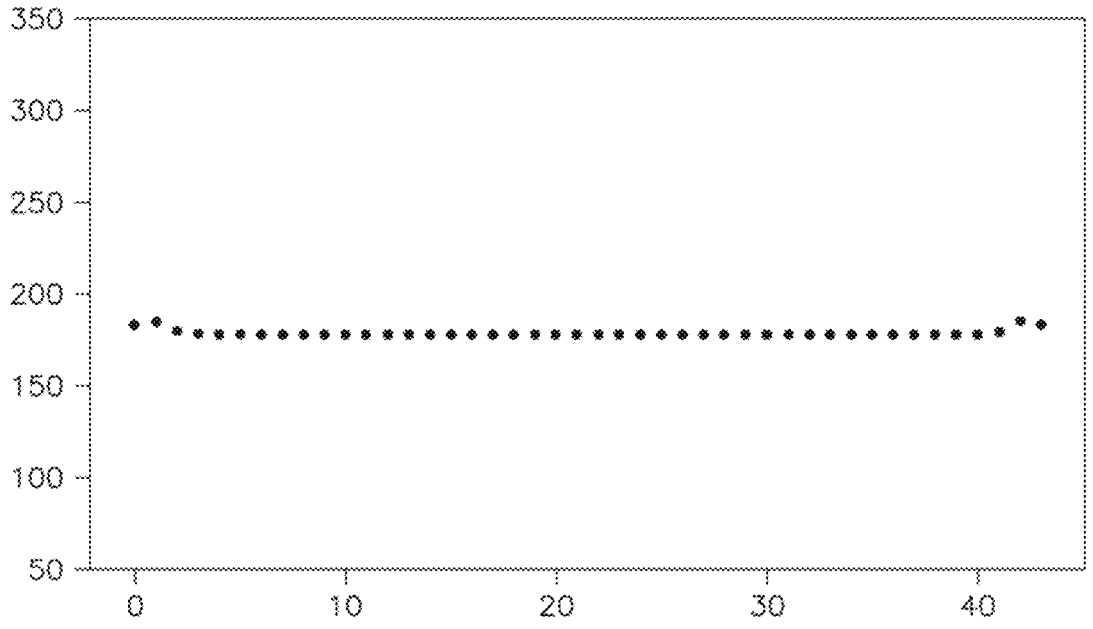

[Fig. 6]
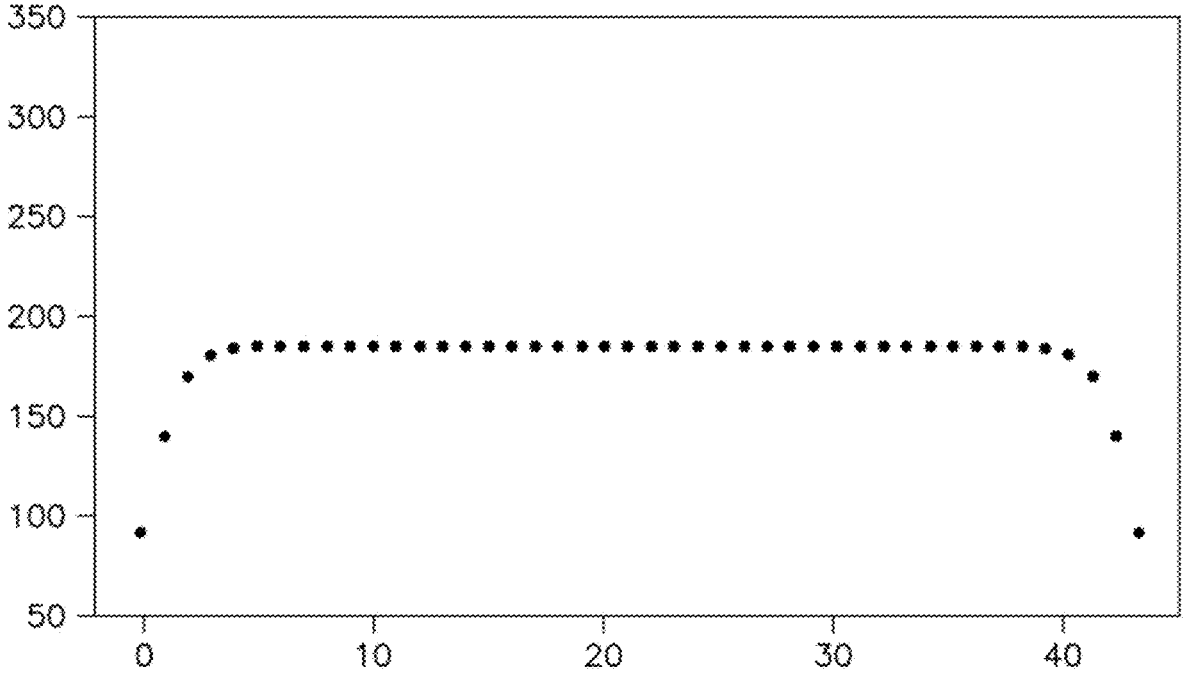

HEAT-EXCHANGE DEVICE COMPRISING FLOW LIMITING DEVICES, AIR-CONDITIONING SYSTEM AND VEHICLE

CROSS-REFERENCE TO RELATED APPLICATIONS

This application is a § 371 national phase entry of International Application No. PCT/EP2022/085259, filed Dec. 9, 2022, which claims priority to French Patent Application No. 2113414 filed on Dec. 13, 2021.

TECHNICAL FIELD OF THE INVENTION

The invention relates to a heat-exchange device, in particular a heat exchanger for an aircraft, comprising at least one flow limiting device.

The invention relates in particular to a plate heat-exchange device, two different heat-transfer fluids flowing between said plates so as to cool or heat a first fluid by means of a second fluid, the two fluids being separated from each other by plates, in contact with which said heat exchange takes place.

Plate heat exchangers integrated into atmospheric vehicles are often subject to steep temperature gradients.

These repeated stresses lead to risks of premature breaking of the elements of the exchanger block (also referred to as "core") and of the appearance of leaks of fluid flowing in the exchanger.

However, it is necessary to retain a structural continuity of the core of such heat exchangers, in particular during manufacture thereof, likely to involve, in particular, soldering steps. It is also desirable to retain a structural rigidity with respect to forces introduced by external stresses (forces at the interfaces, pressure, vibrations . . . ).

TECHNOLOGICAL BACKGROUND

Different solutions have already been proposed in order to increase the thermo-mechanical strength linked to the temperature gradients to which the heat-exchange devices of atmospheric vehicles, in particular aircraft, are subjected.

For example, EP 2 840 345 proposes a cross flow heat exchanger, the separators of which disposed in the hot pass and the cold pass of the exchanger have slots intended to reinforce the mechanical strength of the separators and to limit the propagation of a crack which would be formed following a thermal deformation.

Such a device does not make it possible to satisfactorily increase the thermo-mechanical resistance of a heat-exchange device to temperature gradients.

A heat exchanger according to EP 2 840 345 does not make it possible to prevent the deterioration of the elements of the exchanger block under the effect of the various strains to which such a heat exchanger is subjected, in particular in an aircraft.

The invention thus aims to propose a heat-exchange device enabling these disadvantages to be overcome.

GB 654 395 also discloses a plate heat exchanger comprising a housing in which are disposed the plates forming cells for the flow of a first fluid, another fluid flowing in the housing around said cells. Undulating sheets on both sides of a planar sheet can be provided in the cells so as to increase the heat-transmitting surface area, the undulations of these sheets forming channels extending in parallel with the flow direction of the fluid in said cells.

US 2013/191079 also discloses a cross flow heat exchanger with plates and separators comprising porous blocking bars disposed in parallel with the direction in which the stream of cold fluid flows, each blocking bar comprising pores making it possible to control the stream of hot fluid entering the hot pass.

AIMS OF THE INVENTION

The invention aims to provide a heat-exchange device having a very low level of sensitivity to temperature gradients.

The invention aims, in particular, to provide a heat-exchange device having excellent structural cohesion which is stable over time.

The invention also aims to provide a heat exchange device with an excellent level of efficacy.

DESCRIPTION OF THE INVENTION

In order to achieve this, the invention relates to a heat-exchange device comprising:

- a flow enclosure defined by at least one first lateral plate, referred to as first external plate, and at least one second lateral plate, referred to as second external plate,
- a first inlet for a first heat-transfer fluid into the flow enclosure,
- a first outlet for the first heat-transfer fluid out of the enclosure,
- a second inlet for a second heat-transfer fluid into the flow enclosure,
- a second outlet for the second heat-transfer fluid out of the enclosure,
- a plate exchanger block disposed in the flow enclosure so as to be in fluid communication with the inlets and the outlets in order to allow the flow of the first heat-transfer fluid and of the second heat-transfer fluid in and through this exchanger block and the transfer of calories therebetween, said exchanger block being adapted to allow the flow of a first stream of heat-transfer fluid in said flow enclosure in a direction, referred to as main flow direction of the first fluid, between the first inlet and the first outlet,
- said exchanger block comprising a plurality of internal plates disposed substantially in parallel with each other between two ends of said exchanger block, each space between two adjacent internal plates defining a layer, referred to as internal layer, for flow of one of said first heat-transfer fluid and of said second heat-transfer fluid, said internal plates being disposed substantially in parallel with the external plates,
- characterized in that the first internal layer for flow of said first heat-transfer fluid and the last internal layer for flow of said first heat-transfer fluid, referred to as end internal layers, each comprise at least one device, referred to as flow limiting device, configured to be able to impede, at least in part, the flow of said first stream of fluid in said end internal layer, while allowing the flow of a non-zero stream of fluid.

A heat-exchange device in accordance with the invention thus makes it possible to limit the heat exchanges in at least one end internal layer, in particular a cold layer, of such a heat-exchange device in order to limit the temperature drop in this layer with respect to the temperature at the heart of the exchanger block. A heat exchange device in accordance with the invention consequently makes it possible to limit the temperature differences between the ends and the heart of the core of such an exchanger as well as the resulting deformations. This results in improved structural continuity of said heat-exchange device over time as well as greater mechanical resistance to the thermo-mechanical conditions. This thus makes it possible to avoid the breaking of certain parts able to materialize, for example, following a rotation of a closing bar of the core of a heat-exchange device about its initial longitudinal axis.

Thus, advantageously and in accordance with the invention, only said end internal layers comprise one (or a plurality of) flow limiting device(s). In other words, said flow limiting devices are only present in said end internal layers, i.e. the first internal layer for flow of said first heat-transfer fluid and the last internal layer for flow of said first heat-transfer fluid.

The heat-exchange device in accordance with the invention also comprises a passage, referred to as passage for the second heat-transfer fluid, allowing the flow of a stream of the second heat-transfer fluid in the flow enclosure between the second inlet and the second outlet.

The heat-exchange device in accordance with the invention is adapted to allow the flow of the second heat-transfer fluid in the passage for the second heat-transfer fluid, in a direction, referred to as flow direction of the second fluid, orthogonal to the flow direction of the first fluid. Advantageously and in accordance with the invention, the first heat-transfer fluid flows, in said flow enclosure, in a direction, referred to as main flow direction of the first fluid, extending between the first inlet and the first outlet, said flow direction of the first fluid being orthogonal to the direction, referred to as flow direction of the second fluid, in which the second heat-transfer fluid flows, in said flow enclosure, between the second inlet and the second outlet.

Advantageously and in accordance with the invention, the second heat-transfer fluid is adapted to form a second stream of heat-transfer fluid flowing, in said flow enclosure, in the flow direction of the second fluid, between the second inlet and the second outlet, said flow direction of the second fluid being orthogonal to the main flow direction of the first fluid.

The first heat-transfer fluid and the second heat-transfer fluid flow in the spaces between the internal plates which are closed laterally by closing bars (or rods).

The second heat-transfer fluid can correspond to the fluid which is at a temperature greater than the temperature of the first heat-transfer fluid or vice versa. Thus, advantageously and in accordance with the invention, the second heat-transfer fluid corresponds to the heat-transfer fluid which is at a temperature greater than the temperature of the first heat-transfer fluid. In other words, the first heat-transfer fluid can be termed the "cold" fluid and the second heat-transfer fluid can be termed the "hot" fluid. Thus, each end internal layer is configured to allow the passage of a non-zero stream of said first heat-transfer fluid, the temperature of said second heat-transfer fluid being higher than the temperature of said first heat-transfer fluid.

Advantageously and in accordance with the invention, said end internal layers are layers in which the "cold" fluid flows, i.e. the first heat-transfer fluid, the temperature of which is lower than the temperature of the second heat-transfer fluid.

Advantageously and in accordance with the invention, each heat-transfer fluid can be in liquid or gaseous form. In particular, the state of the first heat-transfer fluid can be identical to, or different from, the state of the second heat-transfer fluid. Advantageously and in accordance with the invention, the first heat-transfer fluid and the second heat-transfer fluid are in gaseous form.

Advantageously and in accordance with the invention, each flow limiting device comprises at least one portion extending substantially along a plane secant (non-parallel) to the main flow direction of the first fluid so as to be able to impede, at least in part, the flow of said first stream of fluid in said end internal layer. Advantageously and in accordance with the invention, each flow limiting device comprises at least one planar portion (or face) extending substantially orthogonally to the main flow direction of the first fluid.

Advantageously and in accordance with the invention, each flow limiting device comprises at least one flow guide adapted to be in the form of a plurality of channels which are substantially in parallel with each other, each flow guide being disposed in each first internal layer and in each last internal layer so that said channels extend in a direction substantially orthogonal to the main flow direction of the first fluid. The channels of each flow guide are formed, at least in part, by lateral walls, these walls forming said planar portions extending principally in a direction which is not substantially in parallel with the main flow direction of the first fluid so as to be able to impede, at least in part, the flow of said first stream of fluid in said end internal layer. Such a flow guide can extend throughout said first internal layer and said last internal layer of the exchanger block. Advantageously and in accordance with the invention, each flow limiting device extends throughout said first internal layer and said last internal layer of the exchanger block. Such a flow guide can also extend only in a portion or a plurality of portions of said first internal layer and of said last internal layer of the exchanger block It is also possible to dispose each flow limiting device formed by a flow guide so that the channels are disposed forming an angle of less than 90° with the main flow direction of the first fluid in the end layer, in particular an angle between 35° and 90°.

Advantageously and in accordance with the invention, said flow limiting device comprises at least one flow guide of an undulating shape. Such a flow guide can be of various shapes and be, for example, in the form of an undulating metal sheet or of an undulating strip or even of fins in a zig-zag arrangement.

According to one particularly advantageous variant of a heat-exchange device in accordance with the invention, each flow guide is formed from a plurality of successive sections, each having a notched profile, so as to form guide walls and regions of surface contact with the plates. In such a flow guide, commonly called an offset flow guide, two successive sections are laterally offset so that the guide walls of a section located directly adjacent to another section are offset laterally (in a direction in parallel with the external plates of the exchanger block) with respect to the guide walls thereof.

Each flow guide can be fixedly attached to the internal plates, e.g. by soldering or by welding. Each flow guide can be fixedly attached to the external plates by a plurality of surface contacts. More particularly, the regions (external and internal) of contact of each flow guide are advantageously soldered to the internal faces of an internal plate and of the first or second internal plate (end plates).

Advantageously and in accordance with the invention, the flow limiting device comprises at least one bar, referred to as flow limiting bar, extending mainly in a longitudinal direction, said bar being disposed so that the longitudinal direction of said bar is orthogonal to the main flow direction of said first fluid, said bar having at least one through-opening, in particular at least two through-openings, adapted to allow the passage of a stream of said first heat-transfer fluid through said through-openings. Said flow limiting bar can be disposed at the inlet or at the outlet of the end internal layer (the inlet and the outlet being defined with respect to the flow direction of the heat-transfer fluid in said internal layer) or in any intermediate position between the inlet and the outlet of said end internal layer. Advantageously and in accordance with the invention, said flow limiting bar is disposed at the inlet of each end internal layer. However, there is nothing to prevent the provision (as a variant or in combination) of two flow limiting bars within each end internal layer, for example a first flow limiting bar at the inlet and a second flow limiting bar at the outlet of said internal layer. More particularly, said flow limiting bar obstructs, partially or entirely, the passage cross-section for the heat-transfer fluid of the first end internal layer and/or of the last end internal layer, except for said through-openings. On the other hand, the number, the distribution, the size and the shape of said through-openings provided in each flow limiting bar can vary.

It is thus possible to optimize the geometric parameters of such flow limiting devices of a heat-exchange device in accordance with the invention and to modulate the stream of heat-transfer fluid (in particular the stream of fluid referred to as cold fluid) and thus to optimize the reduction in the thermal gradient at the ends of the core of a heat-exchange device in accordance with the invention. As far as a flow limiting device in the form of a flow guide is concerned it is possible to choose, depending on the case, the height of the undulations, the width of each flow guide, the offset width between each section . . . .

Such flow guides can also be interleaved between the internal plates, referred to as central plates, distinct from the end internal plates, i.e. disposed between the first and last end internal plates of the exchanger block. Advantageously and in accordance with the invention, each internal layer, referred to as central internal layer, disposed between said first internal layer and said last internal layer of said exchanger block, is provided with at least one flow guide adapted to form a plurality of channels which are substantially in parallel with each other, each flow guide being disposed in said central internal layer so that said channels extend in a direction substantially in parallel with the main flow direction of the heat-transfer fluid in said central internal layer. Each flow guide can have an undulating shape, the height of the undulations is substantially equal to the distance between central internal plates. Thus each flow guide has a plurality of external regions and internal regions in surface contact with the inner face of the internal plates. Each flow guide can have a plurality of undulations so as to form a plurality of flow channels for the first heat-transfer fluid and for the second heat-transfer fluid in the flow enclosure. Each flow guide can have a profile undulating regularly in a periodic shape, for example of the sinusoidal or notched type.

Each flow guide can be fixedly attached to the central internal plates by a plurality of surface contacts. In particular, each flow guide can be fixedly attached to the central internal plates, for example by soldering or by welding.

The use of such flow guides between the central internal plates of the exchanger block is optional but makes it possible to improve the efficacy of the heat exchanges. Internal plates with grooves can also be used.

Advantageously and in accordance with the invention, the internal layers, referred to as central internal layers, disposed between said first internal layer and said last internal layer have no flow limiting device. The flow guides possibly provided within said internal layers and disposed so that the flow channels of said flow guides are oriented substantially in parallel with the flow direction of the fluid in the internal layer, are not considered as flow-limiting in the sense of the present invention. In this way, the heat exchanges being reduced only within the end internal layers of the exchanger block, this makes it possible to limit the thermal gradient between the end internal layers and the central internal layers of such an exchanger block.

The flow enclosure has a closed periphery which is sealed with respect to the heat-transfer fluids (at least in operation and without taking into account inlets and outlets for the first heat-transfer fluid and for the second heat-transfer fluid).

Advantageously and in accordance with the invention, the first inlet has a mouth for letting the first heat-transfer fluid into the flow enclosure. Advantageously and in accordance with the invention, the first outlet has a mouth for letting the first heat-transfer fluid out of the flow enclosure. In a particularly advantageous variant and in accordance with the invention, each mouth has a single orifice forming an inlet or outlet, an opening towards the flow enclosure and/or towards the plate exchanger block, and a solid peripheral wall between this orifice and this opening. Each orifice of each mouth can be connected to a conduit for letting in or evacuating the first heat-transfer fluid.

Advantageously and in accordance with the invention, the course of the first stream of heat-transfer fluid and the course of the second stream of heat-transfer fluid within the exchanger block can be substantially straight. Of course, it is also possible to use any other type of plate exchanger block, for example in which the stream of the one and/or the other of the first or of the second heat-transfer fluid follows a U-shaped or even an S-shaped course.

The heat-exchange device in accordance with the invention can be formed from at least one material chosen from metallic materials, composite materials, polymeric materials, ceramic materials, in particular graphite, glass . . . . In particular, in one particularly advantageous embodiment of a heat-exchange device in accordance with the invention, the plates are formed from a metallic material, in particular from at least one material chosen from the group formed by steels, copper, aluminum, metallic alloys (in particular super-alloys) and mixtures thereof.

The invention relates to an air-conditioning system comprising at least one heat-exchange device in accordance with the invention. It may in particular be a contactless, cross flow exchanger.

The invention relates to a vehicle, in particular an aircraft, comprising at least one air-conditioning system in accordance with the invention.

The invention also relates to a heat-exchange device, an air-conditioning system and a vehicle comprising at least one such air-conditioning system, which are characterized in combination by all or some of the features mentioned above or below.

LIST OF FIGURES

Other aims, features and advantages of the invention will become apparent upon reading the following description given solely in a non-limiting way and which makes reference to the attached figures in which:

FIG. 1 is a schematic view of an exchanger block of a heat-exchange device in accordance with a first embodiment of the invention, FIG. 2 is a schematic cross-sectional view of an exchanger block of a heat-exchange device in accordance with the first embodiment of the invention, FIG. 3 is a schematic perspective view of a detail of an exchanger block of a heat-exchange device in accordance with the invention, FIG. 4 is a schematic cross-sectional view of an exchanger block of a heat-exchange device in accordance with a second embodiment of the invention, FIG. 5 is a graph showing the temperature gradient within an exchanger block of a heat-exchange device in accordance with the second embodiment of the invention, FIG. 6 is a graph showing the temperature gradient within an exchanger block of a heat-exchange device not in accordance with the invention.

DETAILED DESCRIPTION OF AN EMBODIMENT OF THE INVENTION

In the figures, for the purposes of illustration and clarity, scales and proportions have not been strictly respected.

Furthermore, identical, similar or analogous elements are designated by the same reference signs in all the figures.

FIG. 1 schematically illustrates an exchanger block 12 of a heat-exchange device in accordance with a first embodiment of the invention.

The plate exchanger block can comprise, for example, a stack of planar internal plates. The internal plates of the exchanger block comprise:

- at least two central internal plates 13, 15 disposed between a first external plate 2 and a second external plate 2.
- at least one first end internal plate 14 disposed between the central internal plates 13, 15 and the first external plate 2,
- at least one second end internal plate 16, distinct from the first end internal plate 14 and disposed between the central internal plates 13, 15 and the second external plate 2.

A first and a second heat-transfer fluid flow in the spaces between the internal plates 13, 14, 15, 16 closed laterally by closing bars 60, 62.

The internal plates 13, 14, 15, 16 are disposed in parallel with each other. The first heat-transfer fluid, referred to as "cold" fluid, flows in regions of flow of the first heat-transfer fluid in a main flow direction of the first fluid between a first inlet 4 and a first outlet 6. The second heat-transfer fluid flows in regions of flow of the second heat-transfer fluid, which are distinct from the regions of flow of the first heat-transfer fluid, between a second inlet 8 and a second outlet 10.

The internal plates 13, 14, 15, 16 are disposed in parallel with the external plates 2. A first internal layer allows the first heat-transfer fluid to flow between the first end internal plate 14 and an internal plate 18 adjacent to said first end internal plate (the internal plate 18 being the second internal plate of the exchanger block 12), and a last internal layer allows the first heat-transfer fluid to flow between the last internal plate 16 of the exchanger block and an internal plate adjacent to said last internal plate.

At least one flow limiting device is disposed in each end layer, i.e. in the first internal layer and in the last internal layer, the latter extending substantially orthogonally to the main flow direction of the first fluid, so as to impede, at least in part, the flow of the first stream of fluid in the first internal layer and in the last internal layer. However, each flow limiting device naturally continues to allow the flow of a non-zero stream of fluid in the first internal layer and in the last internal layer. Only the end internal layers comprise a flow limiting device, the flow limiting devices being exclusively present in the end internal layers, i.e. the first internal layer for flow of said first heat-transfer fluid and the last internal layer for flow of said first heat-transfer fluid, so as to impede the flow of the first heat-transfer fluid in each end internal layer more strongly than in the central internal layers.

In a heat-exchange device, such an exchanger block is placed in a flow enclosure defined by at least two external lateral plates 2.

In a heat-exchange device not in accordance with the invention, since each end layer is in contact with a single other internal heat exchange plate it contributes to the cooling of only one internal layer, in contrast to the central internal layers which cool two of them. The temperature within the cold end internal layers is thus lower than that within the other central internal layers of the exchanger block.

The fact of limiting the heat exchanges in the end internal layers with respect to the central internal layers within an exchanger block 12 thus makes it possible to limit this usual temperature gradient.

In the first embodiment of a heat-exchange device in accordance with the invention illustrated in FIGS. 1 to 3, the flow limiting device is formed from a flow guide 20, 25 forming a plurality of channels which are in parallel with each other but disposed transversely to the stream of the first heat-transfer fluid. Each flow guide 20, 25 is thus disposed in the first internal layer (see FIG. 2) and in the last internal layer so that said channels extend in a direction substantially orthogonal to the main flow direction of the first fluid. It is also possible to dispose each flow limiting device formed by a flow guide so that the channels are disposed forming an angle of less than 90° with the main flow direction of the first fluid in the end layer, for example an angle between 35° and 90°.

Each flow guide 20, 25, 51 is formed from a plurality of successive sections, each having a notched profile, so as to form guide walls and regions of surface contact with the internal plates. In such a flow guide, commonly called an offset flow guide, as illustrated in FIG. 3, two successive sections are laterally offset by a distance referred to as a half-width 52, so that the guide walls of a section located directly adjacent to another section are offset laterally (in a direction in parallel with the external plates of the exchanger block) with respect to the guide walls thereof. It is thus possible, depending on the case, to choose the height of the undulations, the width 53 of each flow guide or even the offset width 54 between each section. For a flow guide with identical offset, the placement at 90° to the main flow direction of the first fluid makes it possible to limit the flow of the stream of heat-transfer fluid in the end layer to the maximum extent, and thus limits the temperature gradients in the exchanger block 12 to the maximum extent. Thus, the closer said angle with respect to the main flow direction of the first fluid is to 90°, the more the flow of the stream of heat-transfer fluid is impeded.

The path that must then be taken by the first heat-transfer fluid in a flow channel of the first internal layer and of the last internal layer of the exchanger block 12 provided with such an offset flow guide then follows the shape of a succession of Ss disposed one after another, or of notches.

In the illustrated embodiment, the flow guide 20, 25 extends throughout the first internal layer and the last internal layer of the exchanger block 12. This presents, in particular, the advantage of making it possible to retain the structural continuity of the exchanger block.

However, it is also possible to dispose the flow guide 20, 25 only in certain regions of the first internal layer and of the last internal layer of the exchanger block 12.

In the first embodiment, the heat-exchange device comprises only two end layers, i.e. the first internal layer and the last internal layer provided with a flow limiting device (only the cold first internal layer of each end). However, it is also possible to make provision for the heat-exchange device further to comprise a flow limiting device in the third internal layer and/or in the ante-penultimate internal layer (i.e. the cold second internal layer from each end of the exchanger block 12).

In a second embodiment of a heat-exchange device in accordance with the invention illustrated in FIG. 4, the flow limiting device is formed from a flow limiting bar 30 disposed so that its longitudinal direction is orthogonal to the main flow direction of said first fluid. Each flow limiting bar 30 has through-openings 32 adapted to allow the passage of a stream of the first heat-transfer fluid through said through-openings. The flow limiting bar 30 can be disposed at the inlet and/or the outlet of the end internal layer or in any intermediate position between the inlet and the outlet of the end internal layer. In the present second embodiment, the flow limiting bar 30 is disposed at the inlet of the first end internal layer (FIG. 4) and at the inlet of the last end internal layer, i.e. along an edge of each of the internal plates 14, 18, 16 defining the end internal layers.

In the illustrated examples, the course of the first and of the second stream of heat-transfer fluid within the exchanger block is substantially rectilinear (not taking into account the possible sinuosities in the case of a flow guide used as a flow limiting device in accordance with the invention in the end layers). Of course, it is also possible to use any other type of exchanger block with plates, for example in which the stream of one and/or the other of the first or of the second heat-transfer fluid follows a U-shaped or even an S-shaped course.

In each embodiment, each internal layer, referred to as central internal layer, disposed between said first internal layer and said last internal layer of said exchanger block, can also comprise at least one flow guide 50 disposed so that said channels extend in a direction substantially in parallel with the main flow direction of the heat-transfer fluid in this central internal layer. Such a flow guide 50 can extend through the entirety of the internal layer or only in certain portions. In the illustrated embodiments, flow guides 50 extend in each of the central internal layers and throughout each central internal layer.

FIG. 5 illustrates the variation in the temperature in an exchanger block such as that described according to the second embodiment, in conditions of usage in an aircraft, the temperature in ° C. of each internal plate of the exchanger block 12 being shown on the Y axis and the number of internal plates of the exchanger block on the X axis (in this case 42 internal plates, each point shown in FIG. 5 corresponding to an internal plate).

FIG. 6 also illustrates the variation in the temperature in ° C. of each internal plate in an exchanger block of a heat-exchange device different from a heat-exchange device in accordance with the invention, having no flow limiting device in the end layers. In comparison with the curve obtained by the same measuring methods illustrated in FIG. 5, it can be seen that there is a steep temperature gradient at the ends of the exchanger block in the case of the curve shown in FIG. 6 in contrast to FIG. 5.

A heat-exchange device in accordance with the invention thus actually makes it possible to effectively limit the temperature gradients likely to damage the exchanger block.

The invention is not limited to the embodiments described. In particular, the flow guides or even the openings provided through the closing bar can be of different shapes, etc.

The invention claimed is:

1. A heat-exchange device comprising:

a flow enclosure defined by at least one first lateral plate, referred to as first external plate, and at least one second lateral plate, referred to as second external plate, a first inlet for a first heat-transfer fluid into the flow enclosure, a first outlet for said first heat-transfer fluid out of the flow enclosure, a second inlet for a second heat-transfer fluid into the flow enclosure, a second outlet for said second heat-transfer fluid out of the flow enclosure, a plate exchanger block disposed in the flow enclosure so as to be in fluid communication with the inlets and the outlets in order to allow a flow of the first heat-transfer fluid and of the second heat-transfer fluid in and through the plate exchanger block and a transfer of calories therebetween, said plate exchanger block being adapted to allow a flow of a first stream of heat-transfer fluid in said flow enclosure in a direction, referred to as main flow direction of the first heat-transfer fluid, between the first inlet and the first outlet, said plate exchanger block comprising a plurality of internal plates disposed substantially in parallel with each other between two ends of said plate exchanger block, each space between two adjacent internal plates defining a layer, referred to as internal layer, for flow of one of said first heat-transfer fluid and of said second heat-transfer fluid, said internal plates being disposed substantially in parallel with said external plates, wherein a first internal layer for flow of said first heat-transfer fluid and a last internal layer for flow of said first heat-transfer fluid, referred to as end internal layers, each comprise at least one device, referred to as flow-limiting device, configured to be able to impede, at least in part, the flow of said first stream of fluid in said end internal layer, while allowing the flow of a non-zero stream of fluid in said end internal layer, the internal layers, referred to as central internal layers, disposed between said first internal layer and said last internal layer having no flow limiting device, and each flow limiting device comprising at least one planar portion extending substantially orthogonally to said main flow direction of the first fluid.

2. The device as claimed in claim 1, wherein each end internal layer is configured to allow a passage of a non-zero stream of said first heat-transfer fluid, a temperature of said second heat-transfer fluid being higher than a temperature of said first heat-transfer fluid.

3. The device as claimed in claim 1, wherein each flow limiting device comprises at least one flow guide comprising a plurality of channels which are substantially in parallel with each other, each flow guide being disposed in each end internal layer so that said channels extend in a direction substantially orthogonal to the main flow direction of the first fluid.

4. The device as claimed in claim 3, wherein each flow guide extends throughout said first internal layer and throughout said last internal layer for flow of said first heat-transfer fluid of the exchanger block.

5. The device as claimed in claim 1, wherein each flow limiting device comprises at least one bar extending mainly in a longitudinal direction, said bar being disposed so that the longitudinal direction of said bar is orthogonal to the main flow direction of the first heat-transfer fluid, said bar having at least two through-openings adapted to allow the passage of a stream of said first heat-transfer fluid through said through-openings.

6. The device as claimed in claim 1, wherein each internal layer, referred to as central internal layer, disposed between said first internal layer and said last internal layer of said exchanger block, is provided with at least one flow guide adapted to form a plurality of channels which are substantially in parallel with each other, each flow guide being disposed in said central internal layer so that said channels extend in a direction substantially in parallel with the main flow direction of the heat-transfer fluid in said central internal layer.

7. An air-conditioning system comprising:

at least one heat-exchange device comprising:

a flow enclosure defined by at least one first lateral plate, referred to as first external plate, and at least one second lateral plate, referred to as second external plate, a first inlet for a first heat-transfer fluid into the flow enclosure, a first outlet for said first heat-transfer fluid out of the flow enclosure, a second inlet for a second heat-transfer fluid into the flow enclosure, a second outlet for said second heat-transfer fluid out of the flow enclosure, a plate exchanger block disposed in the flow enclosure so as to be in fluid communication with the inlets and the outlets in order to allow a flow of the first heat-transfer fluid and of the second heat-transfer fluid in and through the plate exchanger block and a transfer of calories therebetween, said plate exchanger block being adapted to allow the flow of a first stream of heat-transfer fluid in said flow enclosure in a direction, referred to as main flow direction of the first heat-transfer fluid, between the first inlet and the first outlet, said plate exchanger block comprising a plurality of internal plates disposed substantially in parallel with each other between two ends of said plate exchanger block, each space between two adjacent internal plates defining a layer, referred to as internal layer, for flow of one of said first heat-transfer fluid and of said second heat-transfer fluid, said internal plates being disposed substantially in parallel with said external plates, wherein a first internal layer for flow of said first heat-transfer fluid and a last internal layer for flow of said first heat-transfer fluid, referred to as end internal layers, each comprise at least one device, referred to as flow-limiting device, configured to be able to impede, at least in part, the flow of said first stream of fluid in said end internal layer, while allowing the flow of a non-zero stream of fluid in said end internal layer, the internal layers, referred to as central internal layers, disposed between said first internal layer and said last internal layer having no flow limiting device, and each flow limiting device comprising at least one planar portion extending substantially orthogonally to said main flow direction of the first fluid.

8. An aircraft, comprising:

at least one air-conditioning system comprising at least one heat-exchange device comprising:

a flow enclosure defined by at least one first lateral plate, referred to as first external plate, and at least one second lateral plate, referred to as second external plate, a first inlet for a first heat-transfer fluid into the flow enclosure, a first outlet for said first heat-transfer fluid out of the flow enclosure, a second inlet for a second heat-transfer fluid into the flow enclosure, a second outlet for said second heat-transfer fluid out of the flow enclosure, a plate exchanger block disposed in the flow enclosure so as to be in fluid communication with the inlets and the outlets in order to allow a flow of the first heat-transfer fluid and of the second heat-transfer fluid in and through the plate exchanger block and a transfer of calories therebetween, said plate exchanger block being adapted to allow the flow of a first stream of heat-transfer fluid in said flow enclosure in a direction, referred to as main flow direction of the first heat-transfer fluid, between the first inlet and the first outlet, said plate exchanger block comprising a plurality of internal plates disposed substantially in parallel with each other between two ends of said plate exchanger block, each space between two adjacent internal plates defining a layer, referred to as internal layer, for flow of one of said first heat-transfer fluid and of said second heat-transfer fluid, said internal plates being disposed substantially in parallel with said external plates, wherein a first internal layer for flow of said first heat-transfer fluid and a last internal layer for flow of said first heat-transfer fluid, referred to as end internal layers, each comprise at least one device, referred to as flow-limiting device, configured to be able to impede, at least in part, the flow of said first stream of fluid in said end internal layer, while allowing the flow of a non-zero stream of fluid in said end internal layer, the internal layers, referred to as central internal layers, disposed between said first internal layer and said last internal layer having no flow limiting device, and each flow limiting device comprising at least one planar portion extending substantially orthogonally to said main flow direction of the first fluid.

* * * * *